United States Patent [19]

Harbeke

[11] Patent Number: 4,964,180

[45] Date of Patent: Oct. 23, 1990

[54] SHOWER STRAINER MOUNTING ASSEMBLY

[76] Inventor: Gerold J. Harbeke, 2443 Waterside Cr., Lakeworth, Fla. 33461

[21] Appl. No.: 383,585

[22] Filed: Jul. 24, 1989

[51] Int. Cl.[5] ..... E03C 1/26

[52] U.S. Cl. ..... 4/288; 4/292; 4/286; 4/613; 210/163; 210/164; 210/166; 285/42; 285/159; 285/177

[58] Field of Search ..... 4/613, 288, 292, 612, 4/286, 290, 293, 292; 285/42, 158, 159, 177, 56; 210/163, 164, 165

[56] References Cited

U.S. PATENT DOCUMENTS

| | | | |
|---|---|---|---|
| 1,503,421 | 7/1924 | Innas | 210/163 X |
| 1,731,617 | 10/1929 | Flaming | 285/42 X |
| 1,766,216 | 6/1930 | Fleming | 285/42 X |
| 1,792,345 | 2/1931 | Williams | 285/42 X |
| 1,999,277 | 4/1935 | Boosey | 285/42 X |
| 2,019,779 | 11/1935 | Fleming | 285/42 X |
| 2,490,075 | 12/1949 | Mathais | 285/42 X |
| 2,672,205 | 3/1954 | McDonald | 4/288 |
| 3,198,553 | 8/1965 | Fladung | 285/56 |
| 3,420,552 | 1/1969 | Mork | 4/288 |
| 4,067,072 | 1/1978 | Izzi | 4/288 |
| 4,207,632 | 6/1980 | Savell, Jr. et al. | 285/158 X |
| 4,694,513 | 9/1987 | Kizioh | 4/288 |
| 4,832,375 | 5/1989 | Emberson | 285/177 |

*Primary Examiner*—Henry K. Artis

*Attorney, Agent, or Firm*—Griffin, Branigan & Butler

[57] ABSTRACT

A shower strainer mounting assembly (10) comprises an elongated cast-in adaptor coupling (12) for being cast into concrete having a lower end portion (16) for receiving standard 2 inch pipe (24) and an upper portion end (18) with an inner diameter of at least $3\frac{7}{8}$ inches. A separate pan-mounting flange member (14) comprises a circular tubular portion (36) having a continuous round external surface of a size and shape for fitting snugly into the top of the cast-in adaptor coupling and an internal surface with a diameter of less than 3 5/16 inches but at least 2 11/16 inches in cross section and a flange portion (38) attached to the upper end of the tubular portion extending radially outward from an outer surface (40) thereof. The pan mounting flange member defines female, threaded, holes (42) for receiving bolts (32) extending parallel to an axis (21) of the tubular portion through the flange into the tubular portion on approximately a $3\frac{5}{8}$ inch circle concentric with the circular tubular portion and being positioned substantially radially inwardly from the external surface of the tubular portion. In one embodiment, the tubular portion has circular inner and outer surfaces and the holes are positioned therebetween.

7 Claims, 1 Drawing Sheet

SHOWER STRAINER MOUNTING ASSEMBLY

BACKGROUND OF THE INVENTION

This invention relates generally to the art of shower strainer fittings, and more particularly to a type of shower strainer fitting having a major portion thereof which can be installed when a concrete floor is poured.

Typical shower drain fittings are disclosed in U.S. Pat. Nos. 1,731,617, 1,766,621 and 2,019,779 to Fleming, 1,999,277 to Boosy, and 3,420,552 to Mork. Each of these shower strainer fittings includes a bell-shaped coupling member having a tubular portion at its lower end with a 2 inch pipe female coupling, that is, a coupling with an inner diameter of about 2⅜ inches for receiving a standard shower drain, 2 inch, pipe. An upper end of the bell-shaped coupling includes a flange thereon extending radially outwardly from an outer surface thereof. Threaded holes extend downwardly, parallel to the axis of the tubular portion, through the flange into enlargements on the outer surface of the lower tubular portion for receiving bolts which bolt an annularly-shaped, flat, shower pan clamp to a top surface of the flange. A male threaded tubular stud of a shower strainer is then screwed through a female threaded hole of the shower-pan clamp into the lower tubular portion of the bell-shaped coupling member.

A major disadvantage with such prior art shower strainer mounting assemblies is that when they are installed in concrete floors, spaces, or holes, must be provided in such floors for mounting them. Such spaces are often provided by boring holes in concrete floors and by attaching spacers to concrete forms before concrete is poured. Thereafter, a 2 inch pipe is extended up into the space in the concrete floor and the bell-shaped coupling of a prior-art shower strainer mounting assembly is mounted on the 2 inch pipe. Thereafter, any space left between the bell-shaped coupling and the concrete floor must be filled with a filling material. Such a procedure is labor intensive, and therefore, unduly expensive. Thus, it is an object of this invention to provide a shower strainer mounting assembly which can be mounted in a concrete floor without the necessity of providing a space in the concrete floor for mounting the shower straining mounting assembly.

It is a further object of this invention to provide a shower strainer mounting assembly having a cast-in adaptor coupling which can be cast into a concrete floor of almost any thickness.

It is a further object of this invention to provide a shower strainer mounting assembly which is inexpensive to construct and relatively efficient and easy to use.

SUMMARY

According to principles of this invention, a shower strainer mounting assembly comprises an elongated cast-in adaptor coupling for being cast into concrete with a lower end portion having a circular cross section with an inner diameter of a size for tightly receiving a standard 2 inch pipe, and an upper end portion having a circular cross section with an inner diameter of at least around 3⅞ inches. A separate pan-mounting flange member comprises a circular tubular portion having a continuous round external surface of a size and shape for fitting snugly into the top end of the cast-in adaptor coupling and an internal surface with a diameter of less than 3 5/16 inches at least around 2 11/16 inches in cross section. The pan-mounting flange member further includes a flange portion attached to an upper end of the tubular portion which extends radially outwardly from the outer surface of the tubular portion. The pan mounting flange member defines female threaded holes for receiving bolts. The holes extend parallel to the axis of the tubular portion through the flange into the tubular portion and are located with centers approximately on a 3⅝ inch circle concentric with the circular tubular portion. The holes are positioned substantially radially inwardly from the external surface of the circular tubular portion but not further than a 2 11/16 inch circle concentric with the circular tubular portion.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 1:
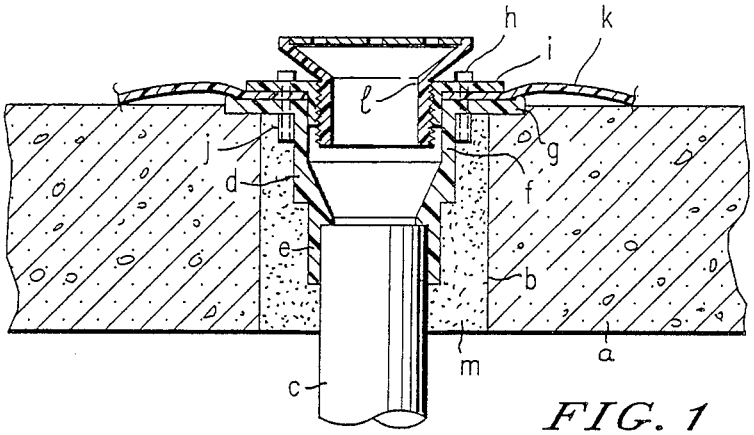
FIG. 1 PRIOR ART
FIG. 1 is a cross sectional view of a prior art shower strainer mounting assembly having a pipe attached thereto at a lower end thereof and being mounted on a concrete floor with a filler in a space between the shower strainer mounting assembly and the concrete floor and a pipe being attached to its lower end.

FIG. 1 discloses a prior art shower strainer mounting assembly installed on a concrete floor with a drain pipe and shower strainer attached thereto. In the prior art, a concrete floor a is first poured with a spacer to produce a round hole b therein. Once the floor a has cured and a form is removed a 2 inch drain pipe c is extended up into the hole b and a prior art shower drain strainer flange d is attached to the upper end of the drain pipe c. The shower-strainer flange d has at its lower end a female coupling e for mating with the drain pipe c and at its upper end a round tubular bell f having an outer diameter of about 3½ inches and an inner diameter of about 3 inches. At the upper end of the bell f is a radially outwardly extending, disc-shaped, pan-mounting, flange member g. Bolts h from a standard shower strainer clamp i extend through threaded holes through the flange member g and protrusions j. It should be understood that in the prior art the bell-shaped shower-strainer flange d is molded of one piece to include the female coupling e, the bell f, the flange member g, and the protrusions j.

The shower strainer clamp i clamps a pan k between the shower strainer clamp i and the flange member g. A shower strainer 1 is screwed into a threaded hole in the shower strainer clamp i to extend down into the bell f.

It should be understood that in the prior art it is necessary to fill the hole b in the floor a with a non-flammable filler m surrounding the shower-strainer flange d which is unduly time consuming.

Figure 2:
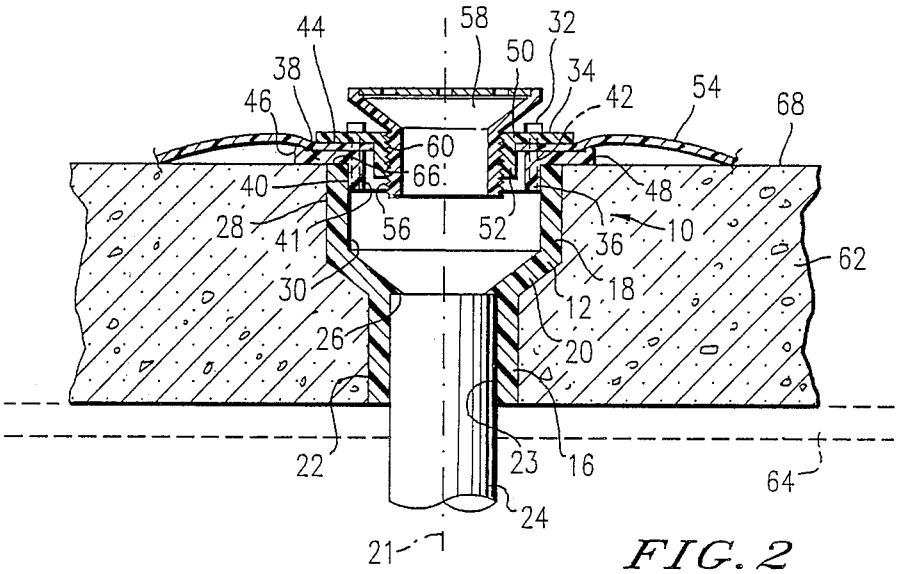
FIG. 2 is a cross sectional view of a shower strainer mounting assembly of this invention cast into a concrete floor with a pipe attached at its lower end and a shower strainer and shower pan mounted at its upper end.
Figure 3:
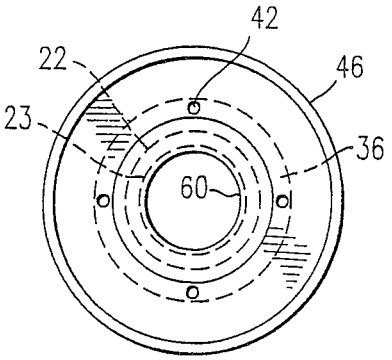
FIG. 3 is a top view of the shower strainer mounting assembly of FIG. 2 of this invention.

Looking now at FIG. 2, a shower strainer mounting assembly 10 of this invention comprises basically an elongated cast-in adaptor coupling 12 and a separate pan-mounting flange member 14.

The elongated cast-in adaptor coupling 12 includes a tubular lower end portion 16, a tubular upper end portion 18, and a funnel shaped transition portion 20 for coupling the lower-end and upper-end portions together. The lower-end portion 16 extends along an axis 21 at least 1 inch, but preferably, is manufactured to be about 3 inches long so as to receive an intumescent collar for fire proofing. A radially inwardly directed surface 23 of the tubular lower end portion 16 has an internal diameter of 2⅜ inches to fit an outer surface of a standard 2 inch internal diameter pipe 24. An annular rib 26 positioned at the connection between the tubular lower end portion 16 and the transition portion 20 contacts the end of the pipe 24 extending into the tubular lower end portion 16.

In the preferred embodiment, the transition portion 20 is less then a ½ inch long.

The tubular upper end portion 18 is about 6 inches long and has a radially outwardly directed outer surface 28 which is approximately ½ inch greater in diameter than a radially inwardly directed inner surface 30. In the preferred embodiment, the diameter of the inner surface 30 is 3 15/16 inches and in any case must be about at least 3 15/16 inches in order to receive therein bolts 32 from a standard shower strainer clamp 34. The wall of the tubular upper end portion 18 is slightly less than a ¼ of an inch thick.

The separate pan-mounting flange member 14 has a circular tubular portion 36 and a disc-shaped flange portion 38. The circular tubular portion 36 is formed by a solid wall with a thickness of about ⅜ inch for receiving ¼ inch bolts 32. A radially directed outer surface 40 must have about the same diameter as the inner surface 30 of the tubular upper portion 18 so that these two members fit snugly together and can be adhered together with a dissolving type adhesive to form a seal therebetween. The pan-mounting flange member 14 defines female threaded holes 42 extending parallel to the axis 21 down through the flange portion 38 into the circular tubular portion 36 for receiving the bolts 32 inside the inner surface 30 of the tubular upper end portion 18. In this regard, a radially directed inner surface 41 has a diameter of around 2 15/16 inches but in any case smaller than 3 5/16 inches so that the circular tubular portion 36 has a sufficient thickness for forming the threaded female holes 42. The flange portion 38 includes on a flat upper surface 44 thereof a circular rib 46 extending about its outer periphery 48.

The shower strainer clamp 34 is of a standard size, having a disc shaped flange portion 50 and a circular tubular portion 52. The flange portion 50 has key shaped holes (not shown) therethrough for receiving the bolts 32, with heads of the bolts 32 passing through enlarged portions of the key-shaped holes. Thus, the disc-shaped flange portion 50 can be placed over four symmetrically placed bolts 32, and then rotated so that smaller sections of these key-shaped holes are positioned under heads of the bolts 32 to lock the disc-shaped flange portion 50 in position. The bolts 32 can then be tightened on a shower pan 54 positioned between the shower strainer clamp 34 and the pan-mounting flange member 14. In this position, the circular tubular portion 52 extends downwardly into the tubular upper end portion 18 of the elongated cast-in adaptor coupling 12 spaced from the circular tubular portion 36 of the support pan-mounting flange member 14. Male threads 56 of a shower strainer 58 can then be screwed into female threads 60 of the circular tubular portion 52.

In operation of the shower strainer mounting assembly 10 of this invention, when a concrete floor 62 is poured, the elongated cast-in adaptor coupling 12 is mounted on a concrete form shown in dashed lines in FIG. 2 as 64 so that it extends perpendicularly upwardly away from the concrete form 64 with a top end 66 thereof extending above the intended top surface 68 of the concrete floor 62. In this respect, in the preferred embodiment, the tubular upper end portion 18 is at least 6 inches long but is cut off later to make the elongated cast-in adaptor coupling 12 the proper length. Thereafter, concrete is poured and cured to form the concrete floor 62. The concrete form 64 is then removed, the upper end portion 18 is cut off at the top surface 68 of the concrete floor 62, and the 2 inch pipe 24 is snugly extended into the tubular lower end portion 16 of the elongated cast-in adaptor coupling 12 and adhered thereto. In this respect, both the elongated cast-in adaptor coupling 12 and the pipe 24 are constructed of a resinous plastic, such as PVC, which can be dissolved welded together. The circular tubular portion 36 of the separate pan-mounting flange member 14 is then extended into the upper end of the tubular upper end portion 18 of the elongated cast-in adaptor coupling 12 and dissolve welded thereto, both of these members being constructed of a resinous plastic. Four symmetrically spaced bolts 32 are either already mounted, or are then inserted, into the female threaded holes 42 and the shower pan 54, having a hole therein, is laid on the flat upper surface 44 of the flange portion 38, with the bolts 32 extending upwardly through the hole in the shower pan 54. Thereafter, the shower pan strainer clamp 34 is mounted on the bolts 32 by extending heads of the bolts 32 through enlarged portions of holes in the disc-shaped flange portion 50 and then rotating the shower strainer clamp 34 so that smaller portions of the holes in the disc-shaped flange portion 50 are positioned under heads of the bolts 32. The bolts 32 are then tightened so as to clamp the shower pan 54 between the disc-shaped flange portion 50 and the flange portion 38. The shower strainer 58 is screwed into the tubular portion 52 of the shower strainer clamp 34.

It can be appreciated by those skilled in the art that the shower strainer mounting assembly of this invention is essentially mounted in a concrete floor when the floor itself is poured. Once the floor has cured, it is relatively easy to attach a drain pipe thereto and it is also relatively easy to cut it off to an appropriate length and attach a standard shower strainer thereto. Further, the shower strainer mounting assembly of this invention is relative easy to construct.

While the invention has been particularly shown and described with reference to a preferred embodiment, it will be understood by those skilled in the art that various changes in form and detail may be made therein without departing from the spirit and scope of the invention. For example, it would be possible to make the tubular upper end portion 18 of the elongated cast-in adaptor coupling to have a larger inner diameter than 4 inches. In this case, it would be necessary to construct the separate pan-mounting flange member 14 to have a circular tubular portion 36 with an outer diameter corresponding to the inner diameter of the tubular upper end portion 18. If this were done, the thickness of the circular tubular portion 36 at the bolts 32 would probably be greater than the rest of the circular tubular portion 36 because the female threaded holes 42 would be positioned further radially inwardly from the outer diameter of the radially-directed outer surface 40 than in the depicted embodiment. In any case, it would be possible to make the circular tubular portion 36 thicker at the female threaded holes 42 than at other places about the periphery of the circular tubular portion 36, thereby effectively reducing the diameter of the radially-directed inner surface 41.

It would also be possible to make a special shower strainer clamp 34, however, it would be preferable to buy such a clamp off-the-shelf.

The embodiments of the invention in which an exclusive property or privilege are claimed are defined as follows:

1. A shower strainer mounting assembly comprising:

an elongated cast-in adaptor coupling for being cast into concrete, said elongated coupling adaptor having a length of at least around 4 inches, a lower end portion of said elongated coupling having a circular cross section with an inner diameter of a size for tightly receiving a standard 2 inch pipe and a top end portion having a circular cross section with an inner diameter of at least 3 5/16 inches;

a separate pan-mounting flange member comprising a circular tubular portion having a continuous round external surface of a size and shape for fitting snugly, about the circumference thereof, into the top end portion of said cast-in adaptor coupling and an internal surface with a diameter of less than 3 5/16 inches but at least around 2 11/16 inches in cross section, said pan-mounting flange member further comprising a flange portion attached to an upper end of said tubular portion and extending radially outwardly from said outer surface thereof, an upper surface of said flange portion facing away from said tubular portion being substantially flat, said pan-mounting flange member defining female threaded holes for receiving bolts, said holes extending parallel to the axis of said tubular portion through said flange into said tubular portion, said holes being located with centers approximately on a 3⅝ inch circle concentric with said circular tubular portion and being positioned substantially radially inwardly spaced from said external surface of said tubular portion;

whereby said cast-in adaptor coupling is mounted to a concrete form and cast into a concrete floor, after curing of said concrete said lower end portion of said cast-in adaptor coupling receives a standard 2 inch pipe and is adhered thereto, said tubular portion of said pan-mounting flange member can be inserted into, and adhered to, the top end of said cast-in adaptor coupling, and a shower pan can be placed on the upper surface of said flange portion, a standard shower strainer clamp can be fastened to said pan-mounting flange member by means of bolts engaged in said female threaded holes, and a shower strainer can be screwed into said shower strainer clamp

2. A shower strainer mounting assembly as in claim 1, wherein said holes are positioned not further radially inwardly from said external surface of said tubular portion than a 2 11/16 inch circle concentric with the tubular portion.

3. A shower strainer mounting assembly as in claim 2, wherein said holes are positioned completely in said tubular portion, said tubular portion having uniformed inner and outer diameters.

4. A shower strainer mounting assembly as in claim 1, wherein said holes are positioned completely in said tubular portion, said tubular portion having uniformed inner and outer diameters.

5. A shower strainer mounting assembly as in claim 1, wherein said top end portion is at least around 6 inches long and said lower end portion is at least around 3 inch long.

6. A shower strainer mounting assembly as in claim 5, wherein is further included an internal rib at the transition between said top end portion and said lower end portion.

7. A shower strainer mounting assembly as in claim 1, wherein is further included an internal rib at the transition between said top end portion and said lower end portion.

* * * * *